US006175354B1

(12) United States Patent
Blissett et al.

(10) Patent No.: US 6,175,354 B1
(45) Date of Patent: Jan. 16, 2001

(54) IMAGE DISPLAY APPARATUS

(75) Inventors: Carl Michael Blissett, Northants; Philip Morgan Griffiths, Bristol; Matthew Englefield, Devizes, all of (GB)

(73) Assignee: Frontline Display International Limited, Bath Avon (GB)

( * ) Notice: Under 35 U.S.C. 154(b), the term of this patent shall be extended for 0 days.

(21) Appl. No.: 09/180,163

(22) PCT Filed: Aug. 20, 1997

(86) PCT No.: PCT/GB97/02230

§ 371 Date: Nov. 3, 1998

§ 102(e) Date: Nov. 3, 1998

(87) PCT Pub. No.: WO98/15942

PCT Pub. Date: Apr. 16, 1998

(30) Foreign Application Priority Data

Oct. 9, 1996 (GB) ..... 9621061

(51) Int. Cl.[7] ..... G09G 3/00; G09G 3/14; G09G 3/34; F21V 21/30; F01D 25/00

(52) U.S. Cl. ..... 345/110; 345/31; 345/39; 362/35; 362/84; 416/5

(58) Field of Search ..... 345/31, 32, 39; 362/35, 84; 416/5

(56) References Cited

U.S. PATENT DOCUMENTS 1,711,859 * 5/1929 Samminiatelli ..... 345/31
4,470,044 * 9/1984 Bell ..... 345/31
4,689,604 * 8/1987 Sokol ..... 345/31
5,548,300 * 8/1996 Tokimoto ..... 345/31
5,670,971 * 9/1997 Tokimoto et al. ..... 345/31
5,717,416 * 2/1998 Chakrabarti ..... 345/31

FOREIGN PATENT DOCUMENTS 02061693 3/1990 (JP) .
WO 96/11462 4/1996 (WO) .

* cited by examiner

*Primary Examiner*—Bipin Shalwala
*Assistant Examiner*—David L Lewis
(74) *Attorney, Agent, or Firm*—Sonnenschein Nath & Rosenthal

(57) ABSTRACT

An image display apparatus comprising a rotatable member carrying an array of light emitting devices; a drive for rotating the member, and a control for selectively energizing each of the light emitting devices in a predetermined sequence as the member rotates so as to present a visible image. The image display device is incorporated in a fan cooling unit having a plurality of blades, the rotatable member being one of the blades of the fan cooling unit. The fan cooling unit includes a sensing arrangement responsive to rotation of the blades, for triggering the control for the energization of the light emitting devices in dependence on the speed of rotation of the blades.

5 Claims, 3 Drawing Sheets

IMAGE DISPLAY APPARATUS

The present invention relates to image display apparatus.

According to the present invention, there is provided image display apparatus comprising-a rotatable member carrying an array of light emitting devices; means for rotating said member; and control means for selectively energising each of said devices in a predetermined sequence as said member rotates so as to present a visible image, characterised in that said apparatus is incorporated in a fan cooling unit, the member being one of the blades of the fan.

The present invention will now be described, by way of example, with reference to the accompanying drawings, in which.

Figure 1:
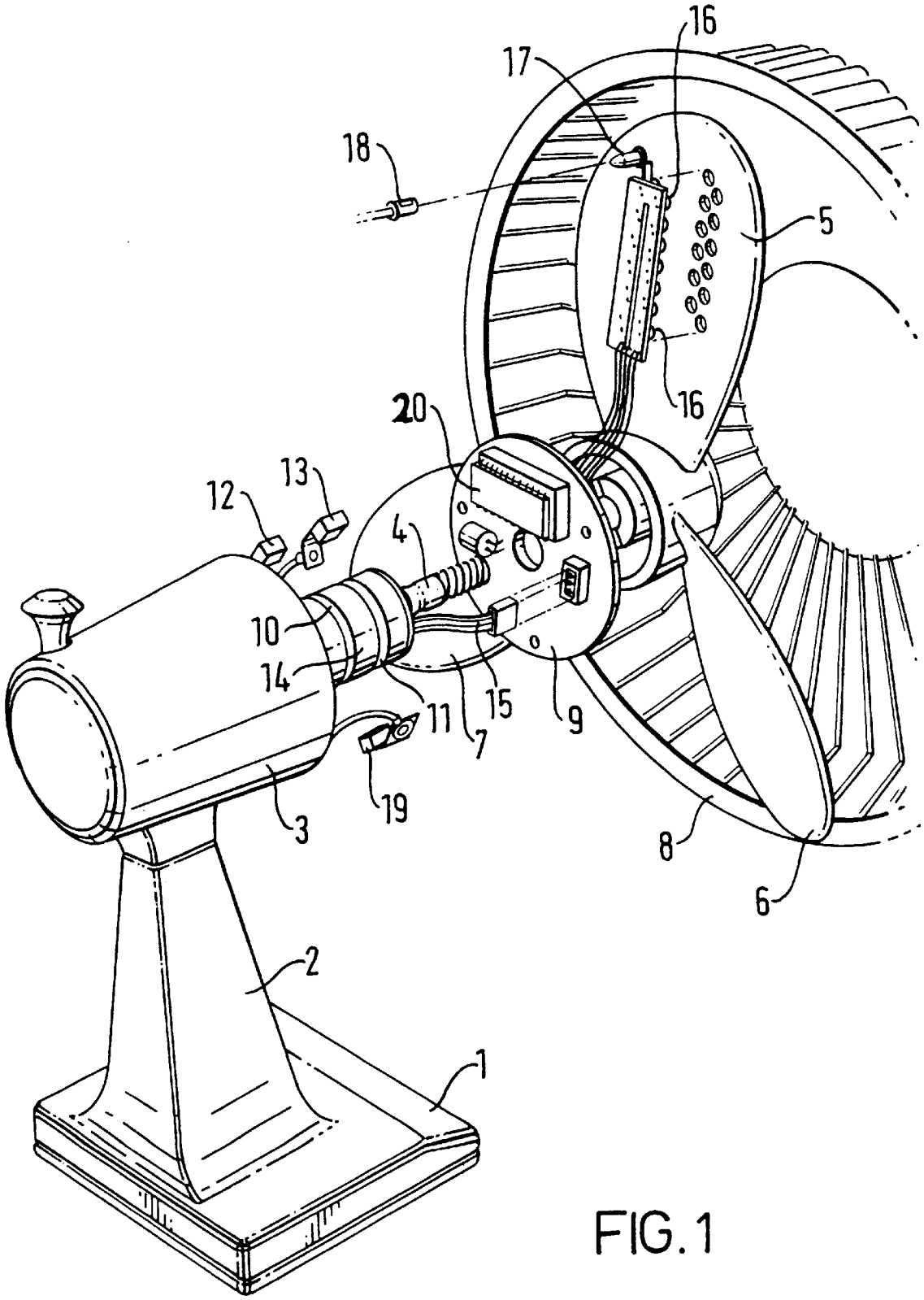
FIG. 1 is an exploded view of a cooling fan unit incorporating the present invention.

Referring to first to FIG. 1, a cooling fan unit comprises a base 1, a pillar 2 and a housing 3 mounted on the pillar 2, there being in the housing 3 a motor (not shown) for rotating via a shaft 4 three fan blades 5, 6 and 7 which are inside a cowling 8.

Reference numeral 9 denotes a fan-mounted printed circuit board which carries a PIC16c5x microcontroller 20. Power is supplied to the printed circuit board 9 via: a pair of carbon brushes 10 and 11 which engage with brass slip rings 12 and 13 fixed to the motor shaft 14; and a power link 15 from the slip rings 12 and 13 to the fan-mounted printed circuit board 9.

Mounted on the blade 5 is an array of light emissive diodes (LEDs) 16, each of which is connected to an output of the microcontroller 20. Reference numeral 17 denotes an infra-red switch mounted on the blade 5 and reference numeral 18 denotes an infra-red source mounted on a cage of the fan (not shown for clarity).

Operation of the cooling fan unit to present a visual image to an observer will now be described.

If a bright image is placed in front of the eye and removed, the brain will perceive it still to be there for a short while after it is removed. This is the principle behind the operation of images produced by the LEDs 16 as fan blade 5 rotates.

Figure 2:
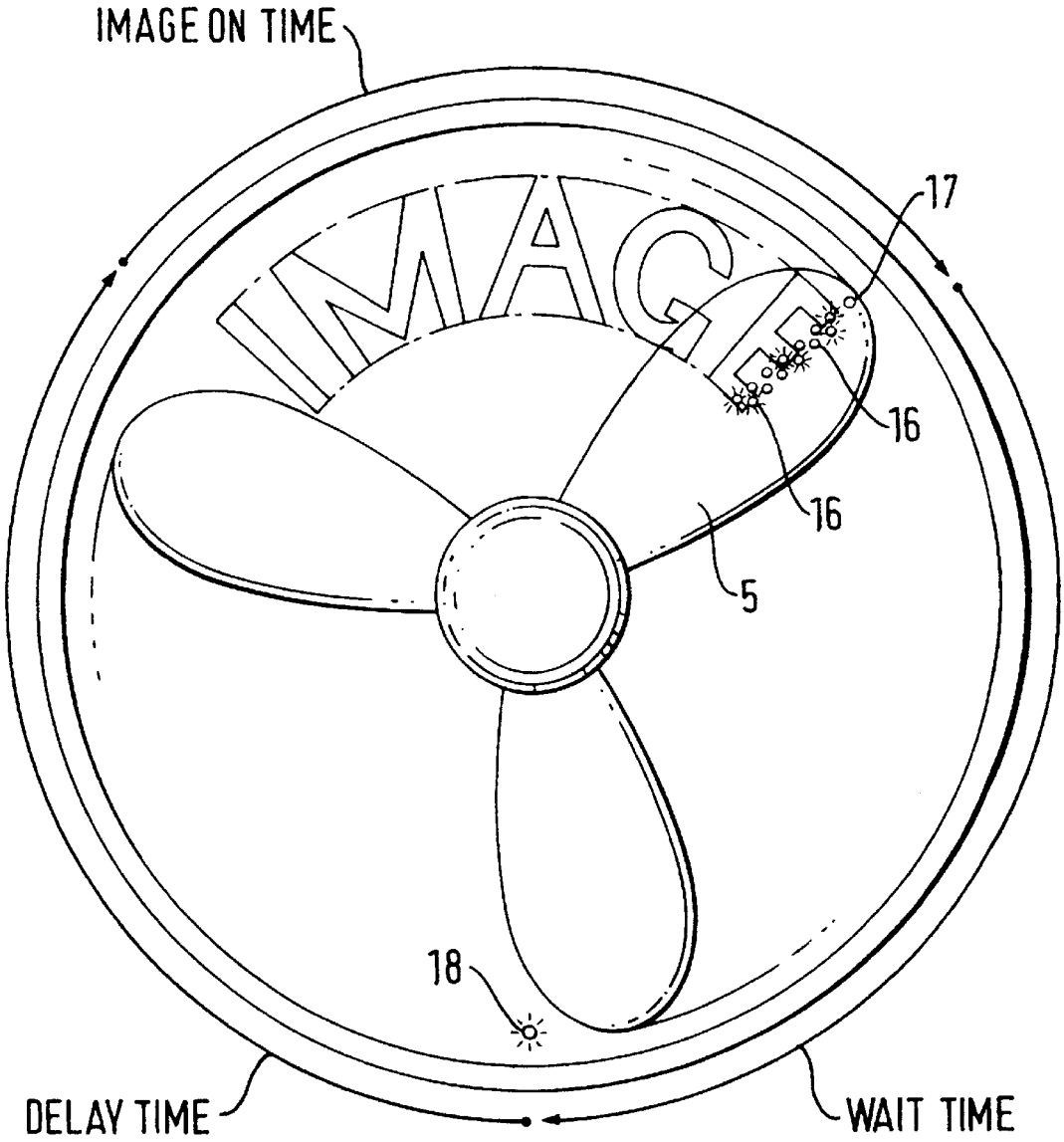
FIG. 2 shows the production of a visible image.
Figure 3:
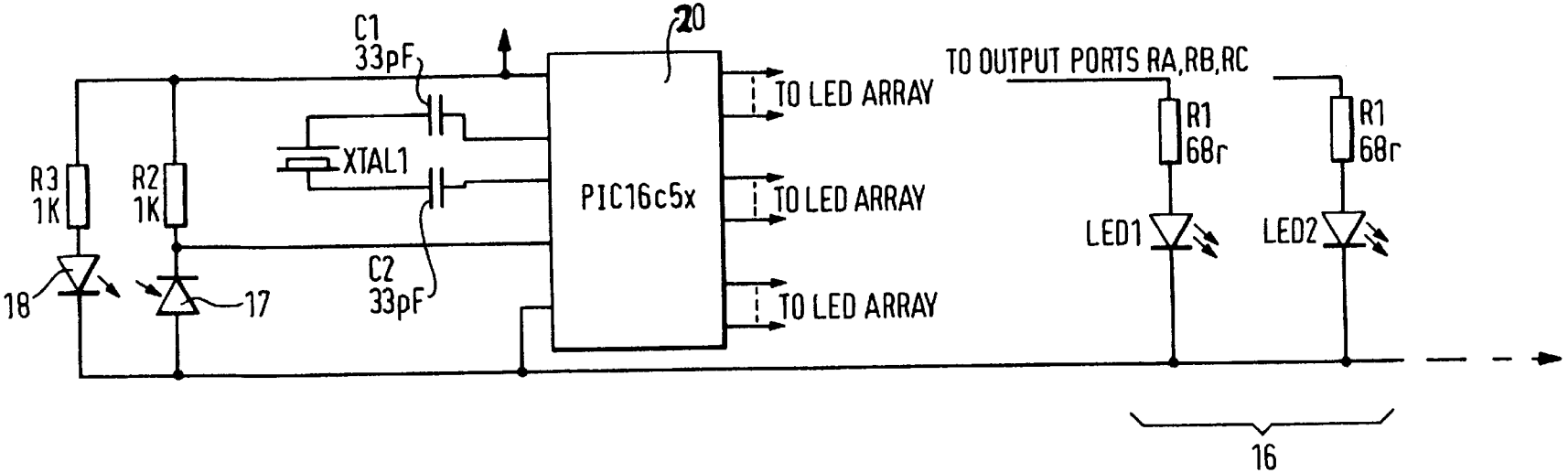
FIG. 3 is a diagram of circuitry incorporated in the fan cooling unit.

As blade 5 rotates (preferably at a speed fast enough for its position at a given instant not to be discernible by the eye, although lower speeds are possible) infra-red switch 17 is used to provide a reference point when it passes infra-red source 18. Whenever the blade 5 passes this point, it will trigger a counter of the microcontroller 20. The counter will initially measure the time it takes for a complete revolution of the blade. (This is necessary so as to allow the fan to be run at varying speeds). From this the microcontroller 20 calculates a "delay time" where there is no image generated and an "image on time" where the image will be displayed (see FIG. 2).

During the "image on time", the microcontroller 20 selectively pulses the LEDs 16 on and off according to a pattern that is stored in memory and the speed of rotation. This pattern could be a digitized image of a logo that it is desired to display. For this purpose an image is placed under a grid that is divided into 19 rows and 80 columns. Then data tables are devised from this that represent when the LEDs are on/off.

As the blade 5 rotates the microcontroller 20 outputs the first column of data, waits for a predetermined time (e.g. 250 $\mu$s) and then outputs the next column of data. This is repeated until all of the data table has been outputted. To obtain a full, clear image the LEDs 16 are arranged in two staggered columns. If this was not done the image obtained would appear striped. A short wait time follows until the infra-red switch 17 passes the infra-red source 18 and the whole process is repeated.

Several different images may be displayed by changing the data table that is selected within the microcontroller 20.

For future modification a third slip ring 19 is provided. This would be used to transmit image data from a storage device not mounted to the fan blades. This will be necessary when many messages are to be stored. It is also possible for a modified version to have red, yellow and blue LEDs mounted to separate fan blades, allowing the colours to be mixed by illuminating the LEDs at the appropriate time and superimposing one colour on top of another.

What is claimed is:

1. Image display apparatus comprising: a rotatable member carrying an array of light emitting devices; a drive for rotating said member; and a control for selectively energizing each of said devices in a predetermined sequence as said member rotates so as to present a visible image, the apparatus being incorporated in a fan cooling unit having a plurality of blades, said member being one of the blades of the fan cooling unit; and the fan cooling unit includes a sensing arrangement responsive to rotation of said blades, said sensing arrangement triggering said control for the energization of said devices in dependence on the speed of rotation of the blades.

2. Apparatus according to claim 1, wherein said control is carried by a circuit board which rotates with the blades of the fan cooling unit.

3. Apparatus according to claim 2, wherein the fan cooling unit is provided with slip rings which rotate with the blades, there being a link between the slip rings and the circuit board for supplying power to the control via brushes in contact with the slip rings.

4. Apparatus according to claim 1, wherein said sensing arrangement senses the start and end of a revolution of said one of the blades.

5. Apparatus according to claim 4, wherein said sensing arrangement comprises an infra-red source and an infra-red switch, one of said infra-red source and said infra-red switch being mounted on said one of the blades.

* * * * *